US006314670B1

(12) United States Patent
Rodney, Jr.

(10) Patent No.: US 6,314,670 B1
(45) Date of Patent: Nov. 13, 2001

(54) MUZZLE LOADER WITH SMOKELESS POWDER CAPABILITY

(76) Inventor: Frederick W. Rodney, Jr., 134 Flagg Rd., Rochester, NH (US) 03867

( * ) Notice: Subject to any disclaimer, the term of this patent is extended or adjusted under 35 U.S.C. 154(b) by 0 days.

(21) Appl. No.: 09/244,366

(22) Filed: Feb. 4, 1999

(51) Int. Cl.[7] ..... F41C 7/00
(52) U.S. Cl. ..... 42/51; 42/83; 89/27.13
(58) Field of Search ..... 42/51, 83; 89/27.13

(56) References Cited

U.S. PATENT DOCUMENTS

| | | | |
|---|---|---|---|
| 1,422 | 12/1839 | Smith | 42/51 |
| 1,544 | 4/1840 | Stocker et al. | 42/51 |
| 1,565 | 4/1840 | Clark | 42/51 |
| 11,483 | 8/1854 | Knight | 42/51 |
| 29,676 | 8/1860 | Davis | 42/51 |
| 44,784 | 10/1864 | Colvin | 42/51 |
| 237,357 | 2/1881 | Zundorff | 42/51 |
| 269,152 | 12/1882 | Zundorff | 42/51 |
| 315,746 | 4/1885 | De Arguibel | 42/51 |
| 331,792 | 12/1885 | Ingersoll | 42/51 |
| 1,747,057 | 2/1930 | Driggs, Jr. et al. | 42/51 |
| 2,085,031 | 6/1937 | Lockhead | 42/1 |
| 2,699,094 | 1/1955 | Musser | 89/1.7 |
| 3,225,655 | 12/1965 | Inglis | 89/1.7 |
| 3,757,447 | 9/1973 | Rowe | 42/51 |
| 3,771,459 | 11/1973 | Lohnstein | 102/97 |
| 3,780,464 | 12/1973 | Anderson | 42/69 R |
| 3,788,188 | 1/1974 | Donner | 89/1 F |
| 4,222,191 | 9/1980 | Lee et al. | 42/77 |
| 4,227,330 | 10/1980 | Chapin | 42/77 |
| 4,232,468 | 11/1980 | Chapin | 42/77 |
| 4,503,633 | 3/1985 | Davis | 42/51 |
| 4,715,139 | 12/1987 | Rodney, Jr. | 42/51 |
| 4,854,065 | 8/1989 | French et al. | 42/65 |
| 4,888,901 | 12/1989 | French et al. | 42/51 |
| 4,918,849 | 4/1990 | Spota | 42/51 |
| 5,408,776 * | 4/1995 | Mahn et al. | 42/51 |
| 5,435,089 * | 7/1995 | Rodney, Jr. | 42/51 |
| 5,487,232 * | 1/1996 | Osborne et al. | 42/51 |
| 5,561,934 * | 10/1996 | Knight | 42/51 |
| 5,623,779 * | 4/1997 | Rainey, III | 42/51 |
| 5,706,598 * | 1/1998 | Johnston | 42/51 |
| 5,737,863 | 4/1998 | Rainey, III | 42/51 |
| 5,860,240 * | 1/1999 | Ball et al. | 42/51 |

FOREIGN PATENT DOCUMENTS

| | | |
|---|---|---|
| 237415 | 8/1945 | (CH) . |
| 299148 | 12/1919 | (DE) . |
| 23 55 506 | 5/1975 | (DE) . |
| 2 520 859 | 8/1983 | (FR) . |
| 14806 | 12/1885 | (GB) . |

* cited by examiner

*Primary Examiner*—J. Woodrow Eldred
(74) *Attorney, Agent, or Firm*—Davis & Bujold, P.L.L.C.

(57) ABSTRACT

A muzzle loader firearm having a primer cavity that is sized to have an interference fit with a desired primer, to be received therein, so that an outwardly facing surface of the exterior casing of the primer, upon being discharged, expands and forms a fluid tight seal with an interior surface of the primer cavity to prevent the escape of any significant gases therebetween. The firearm is provided with a small head space which only allows minor rearward movement of the primer, upon being discharged within the primer cavity, to maintain an adequate fluid tight seal, formed between the outwardly facing surface of the primer casing with the inwardly facing surface of the primer cavity. To facilitate an increased temperature of the primer charge, upon being discharged, the primer cavity communicates with the ignition bore via an oxygen recess that is sized to accommodate a desired quantity of oxygen to facilitate a more rapid and hotter burning of the primer charge. The hotter burning primer charge, in turn, causes a more rapid and complete burning of the gun powder, and especially smokeless gun powder, loaded within the breech end of the gun barrel.

20 Claims, 6 Drawing Sheets

MUZZLE LOADER WITH SMOKELESS POWDER CAPABILITY

FIELD OF THE INVENTION

The present invention relates to an improvement concerning a muzzle loader firearm and, more specifically, to a muzzle loader firearm having the capability of discharging smokeless powder, in a safe manner, to increase both the velocity and accuracy of a discharged bullet or projectile while also minimizing the associated cleaning and maintenance of the muzzle loader firearm.

BACKGROUND OF THE INVENTION

There are a variety of black powder, single shot firearms currently available in the marketplace. These modern weapons are based upon the traditional muzzle loading, black powder weapons of the past, yet they incorporate modern materials and technological advances. Recent improvements have brought such weapons to a modern renaissance by increasing their effectiveness while still relying on a sense of history and tradition important to the contemporary black powder hunter and rifleman.

A major drawback associated with all of such firearms is that they are only currently able to discharge black powder or Pyrodex®. Even the newest and most advanced muzzle loaders are not designed to withstand the forces and pressures generated by the use of smokeless powder as a propellant in single shot muzzle loading weapons. In particular, there are strong warnings against discharging smokeless gun powder in such firearms. Smokeless powder is a substantially more powerful propellant which, if improperly used, significantly increases the risk of blow ups.

Not only does smokeless gun powder increase the velocity, accuracy and power available, but smokeless gun powder is much less corrosive than black powder or Pyrodex® gun powder and a weapon utilizing this propellant thus requires less cleaning or maintenance. Consequently, it is imperative for safety reasons that if smokeless gun powder is to be utilized in a weapon, it is desirable to design a muzzle loader which is capable of safely discharging both black powder or Pyrodex® gun powder as well as smokeless gun powder.

Typically, black powder and Pyrodex® gun powders have a standard burn rate which, by contemporary standards, is relatively slow. Upon discharge of the weapon, the powder ignites and burns, causing an explosion force that is generated within the breech end of the gun barrel. The exploding powder causes the projectile, e.g. the slug, round ball or bullet, to be very swiftly conveyed along the length of the gun barrel and discharged out the muzzle end of the gun barrel.

On the other hand, when smokeless gun powder is discharged within a gun barrel, it achieves a drastically increased burn rate compared to that of conventional gun powder. The rapid burn rate produces gases within the breech end of the gun barrel and it is the expansion of such gases that causes the projectile. e.g. the slug, round ball or bullet, to be swiftly forced out of the muzzle end of the gun barrel.

Upon discharging a firearm containing either black powder or Pyrodex® gun powder, typically a force of about 7,000 to about 20,000 pounds per square inch is generated within the gun barrel, depending upon the quantity or charge of gun powder contained within the gun barrel. Upon discharging a firearm containing smokeless gun powder having the same quantity or charge as with black or Pyrodex® gun powder, typically a force of between about 20,000 to about 62,000 pounds per square inch or so can be generated within the gun barrel.

It is of the utmost importance when using such a volatile propellent to ensure that substantially all the formed gases are directed down the length of the barrel and out the muzzle end. As is readily apparent from even a basic understanding of expanding gases, any generated gas expansion force not directed down the length of the barrel must be allowed to expended and exhaust somewhere else. Unfortunately, the only other path for the expanding gases is back through the ignition bore or orifice hole, out the breech plug and into the face of the rifleman. Therefore, it is desirable to limit any rapid backward escape of such formed gases through the ignition bore or orifice hole provided in the breech plug supported by the breech end of the gun barrel. If significant excess gases are allowed to escape via the ignition bore or orifice hole, formed in the breach plug, there is a real potential that the breech end of the gun barrel could explode in the face of the operator, burn the face or body part of an operator or otherwise seriously injure or mortally wound the operator.

SUMMARY OF THE INVENTION

Wherefore, it is an object of the present invention to overcome the above noted drawbacks of the prior art muzzle loaders.

A further object of the invention is to provide a muzzle loader which is capable of discharging both black powder or Pyrodex® gun powder as well as smokeless gun powder in a safe and efficient manner while increasing the velocity and accuracy of a discharged round ball, bullet or slug, hereinafter referred to as a "projectile".

Still another object of the invention is to provide a firearm discharge system which minimizes fouling of the gun barrel, during and following use of the firearm, simplifies cleaning of the firearm and also minimizes corrosion of the firearm during storage.

Another object of the invention is to provide the breech end of the gun barrel with a sealing capability such that, upon discharging the firearm, the primer located within the primer cavity formed in the breech plug forms an effective seal with the inner wall or surface of the primer cavity such that substantially most of the generated thrust from the rapid burning or explosion of the gun powder, e.g. expansion gases, contained within the gun barrel is exhausted out through the muzzle end of the gun barrel thereby to minimize any back flow of the expansion gases, generated by the rapid burning or explosion of the gun powder, toward the face of the operator of the firearm and thus to improve the output velocity of the projectile being discharged by the firearm.

Yet another object of the present invention is to provide a primer cavity which has a slight taper such that the end portion of the primer cavity, facing the firing pin assembly, is wider than the end portion of the primer cavity carrying the ignition bore or orifice hole which communicates with the gun powder located within the breech end of the gun barrel.

A still further object of the invention is to utilize a slightly longer primer, having a sufficient charge to facilitate a rapid burning of the (smokeless) gun powder, which is located in a slightly longer primer cavity to facilitate an adequate seal between the primer and the inner wall or surface of the primer cavity, upon discharging the primer, to minimize the possibility of any substantial expansion or explosion gases being exhausted past the primer and the primer cavity interface.

Another object of the present invention is to provide an arrangement which facilitates quick, consistent, precise and easy loading of a projectile into the muzzle of a gun barrel.

Yet another object of the invention is to ensure that the central longitudinal axis of the projectile, once loaded, substantially coincides with the central longitudinal axis of the gun barrel so that a complete peripheral seal between the exterior surface of the projectile and the interior rifled surface of the gun barrel is achieved to prevent any of the expansion or explosion gases, generated upon the burning or explosion of the gun powder, from escaping or leaking past the seal formed therebetween.

A further objection of the invention is to facilitate engagement between a muzzle loading tool and the muzzle end of the gun barrel so that the projectile, gun powder, and/or wad can be loaded into the central bore of the gun barrel in a quick continuous motion while still ensuring proper alignment.

The present invention also relates to a muzzle loader firearm comprising: a gun barrel having a breech end and a muzzle end, the breech end of the gun barrel supporting a breech plug having a primer cavity for supporting a desired primer for discharging the firearm, and the primer cavity communicating with an interior space of the breech end of the gun barrel via an ignition bore to facilitate discharge of the firearm when desired; the primer having a sufficiently tight fit with the primer cavity so that upon detonation of the primer, an exterior casing of the primer expands to form a fluid tight seal with an inwardly facing surface of the primer cavity to minimize the passage of any gas therebetween, upon discharge of the firearm; a firing pin assembly being provided for striking the primer, when desired, and discharging the firearm; a trigger mechanism being coupled to the firing pin assembly to control actuation thereof; a stock supporting at least the trigger mechanism, the firing pin assembly and the breech end of the gun barrel; and said firearm having a sufficiently small head space, being provided between an end face of the breech plug, facing the firing pin assembly, and an adjacent surface of the firing pin assembly to prevent the primer from being forced sufficiently rearwardly, upon detonation of the primer, and compromising the fluid tight seal formed between the primer casing and the primer cavity.

The present invention also related to a method of discharging a muzzle loader firearm containing smokeless gun powder, the method comprising the steps of: providing a gun barrel with a breech end and a muzzle end, supporting a breech plug in the breech end of the gun barrel, the breech plug having a primer cavity for supporting a desired primer for discharging the firearm, and the primer cavity communicating with an interior space of the breech end of the gun barrel via an ignition bore to facilitate discharge of the firearm when desired; placing the primer at least partially within the primer cavity with the primer having a sufficiently tight fit with the primer cavity so that upon detonation of the primer, an exterior casing of the primer expands to form a fluid tight seal with an inwardly facing surface of the primer cavity to minimize the passage of any gases therebetween upon discharge of the firearm; providing a firing pin assembly for striking the primer, when desired, and discharging the firearm; coupling a trigger mechanism to the firing pin assembly to control actuation thereof; supporting at least the trigger mechanism, the firing pin assembly and the breech end of the gun barrel by a stock; and providing said firearm with a sufficiently small head space, between an end face of the breech plug facing the firing pin assembly, and an adjacent surface of the firing pin assembly, to prevent the primer from being forced sufficiently rearwardly, upon detonation of the primer, and compromising the fluid tight seal formed between the primer casing and the primer cavity.

The term "primer", as used in this patent application, the claims and the appended drawings means, for example, a shotgun primer, a pistol primer, and/or a 22-blank and also includes all other types of conventional firearm ignition systems which (1) have some sort of exterior casing or shell, made from plastic or metal, and (2) contains an explosive or a detonatable or otherwise ignitable charge for igniting any type of gun powder.

The term "head space", as used in the drawings, the claims and the following description, means a space which is formed between a forward facing surface of the "lock up system", e.g. a bolt action or a drop block head or any other solid wall of the system which facilitates locking of the primer within the chamber of the firearm, and a rearward facing striking surface of the primer. In particular, it is the distance between the striking surface of the primer and the adjacent forward facing surface of the lock up system once the primer is located in the chamber and seated therein. The forward facing surface of the lock up system acts as a stop to prevent excessive rearward movement of the primer, relative to the primer cavity upon discharging the firearm.

BRIEF DESCRIPTION OF THE DRAWINGS

The invention will now be described, by way of example, with reference to the accompanying drawings in which.

DESCRIPTION OF THE PREFERRED EMBODIMENT(S)

Figure 1:
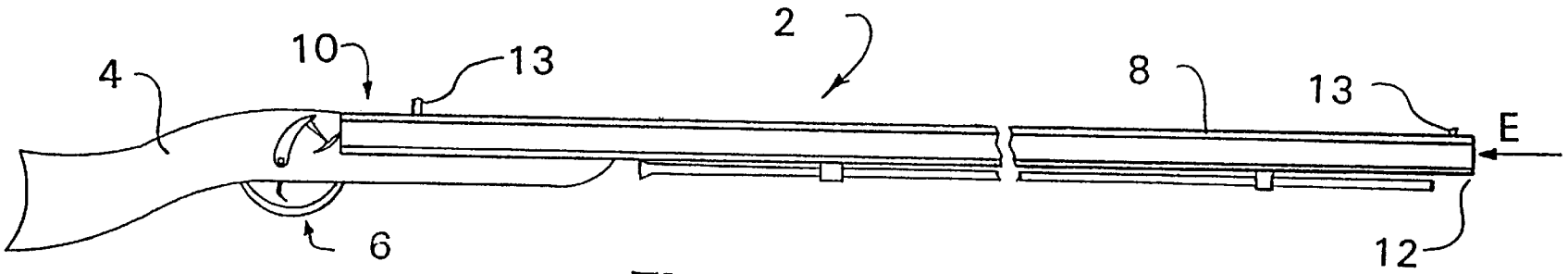
FIG. 1 is a diagrammatic representation showing the basic external components and functional aspects of a conventional muzzle loader firearm.

Turning first to FIG. 1, a brief description concerning the basic components of a conventional muzzle loader firearm 2 will now be provided. As can be seen in this Figure, the firearm 2 comprises a stock 4, manufactured from wood or plastic for example and formed in a generally traditional style although more conventional style stock designs are possible. The stock 4 supports a gun barrel 6, and also accommodates a conventional trigger 8 which is coupled to actuate a conventional firing assembly 10 having a centrally located firing pin 11 (FIG. 2) for causing discharge of the firearm. It is to be appreciated that the firing pin 11 typically has a smaller diameter, e.g. a diameter of about 0.050 to about 0.500 inches, than that of a conventional black powder firearm. The muzzle loader firearm 2 is further equipped with a conventional ramrod 12, to facilitate loading of the gun powder and the desired projectile, and, if desired, possibly a wad located between the gun powder and the projectile.

The firearm 2 is also typically equipped with a pair of spaced apart gun sights 14, one located adjacent the breech end 18 of the gun barrel and the other located adjacent the muzzle end 19 of the gun barrel, and/or possibly a scope (not shown in this Figure), a trigger guard as well as any other accouterments which are traditionally utilized with such a weapon, such as a shoulder sling (not shown in detail). As all of the above discussed features of the firearm are standard and well known in this art, a further detailed description concerning the purpose and functions of those components is not provided.

Figure 2:
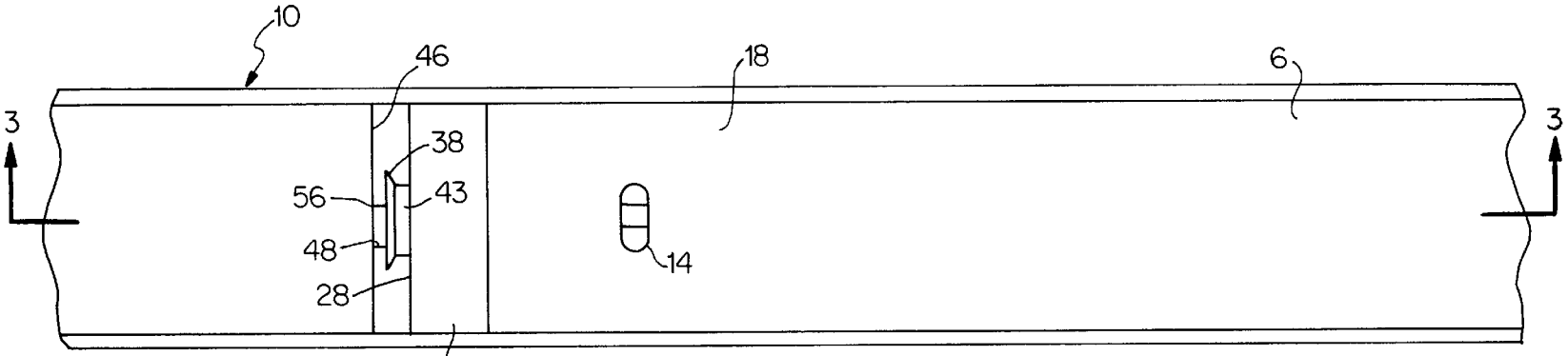
FIG. 2 is a partial diagrammatic top plan view of the breech end/firing assembly of the muzzle loader firearm according to the present invention.
Figure 3:
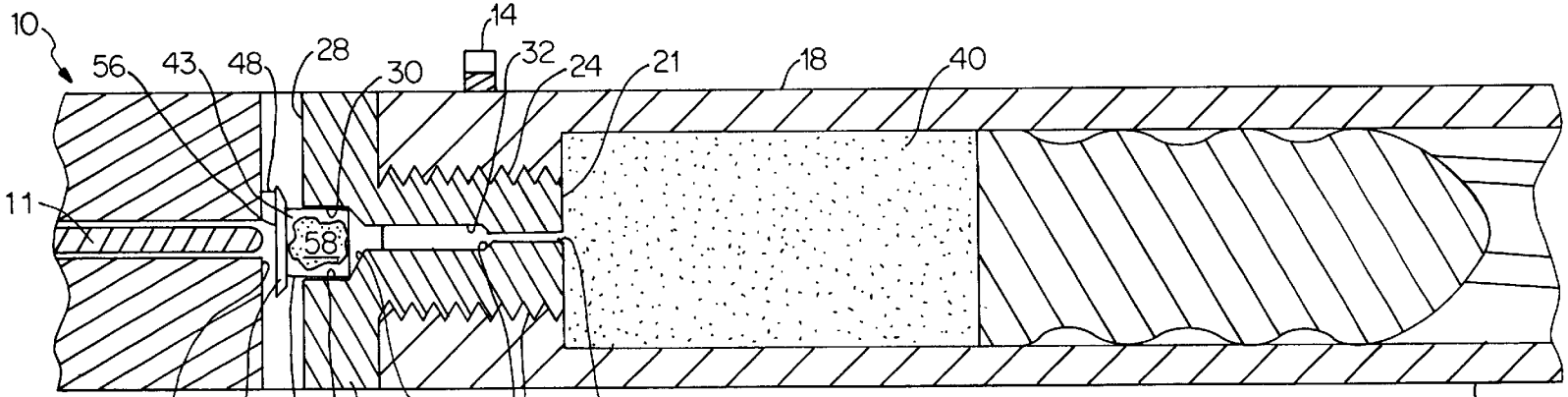
FIG. 3 is a partial diagrammatic cross sectional view of the breech end/firing assembly of FIG. 2 along section line 3—3.

Turning now to FIGS. 2 and 3, a detailed description concerning the improvements, according to the present invention, will now be provided. As can be seen in FIG. 2, the breech end 18 of the gun barrel 6 is provided with an inwardly facing threaded bore 20 which is sized to receive a first end 21 of a breech plug 22 carrying a mating male thread 24. The threaded bore 20 and mating male thread 24 of the first end 21 facilitate removing the breech plug 22 from the breech end 18 of the gun barrel 6 for cleaning and maintenance, interchanging with another breech plug and/or replacement thereof.

The breech plug 22 is typically made from stainless steel, e.g. 416 stainless steel which is heat treated to a 38/42 R.C. (Rockwell Hardness), or some other strong, durable, non-corrosive metal. The second end of the breech plug 22 has an end face 28 that has a cylindrical primer cavity 30 formed therein which typically has a diameter of about 0.15 to about 0.35 inches, preferably about 0.244–5 inches, and typically has a cylindrical axial bore length of approximately 0.080 to about 0.250 inches, preferably about 0.10–0.13 inches, or so. The primer cavity 30 directly communicates with a cylindrical intermediate oxygen bore or recess 32 which, in turn, communicates with a cylindrical ignition bore or orifice hole 34. A first chamfer 35 of between approximately 45° and 75°, preferably a chamfer of about 60°, is provided between the primer cavity 30 and the intermediate oxygen bore or recess 32. The oxygen recess 32 is a cavity designed to accommodate a sufficient quantity of oxygen therein, e.g. between about 0.00471 and about 0.1923 cubic inches, preferably about 0.0540 cubic inches, to facilitate a hotter burning of the primer charge 38, once discharged. The ignition bore or orifice hole 34 channels the resultant primer charge to facilitate, in turn, a complete and adequate burning of the gun powder 40, and a further detailed description concerning the purpose and function of the same will follow below.

The oxygen recess 32 typically has a diameter of about 0.030 to about 0.245 inches, preferably about 0.082 inches, and an axial bore length of about 0.10 to about 0.50 inches, preferably about 0.42 inches. The end of the oxygen recess 32, remote from the primer cavity 30, communicates with the ignition bore or orifice hole 34 via a tapered, second funnel shaped transition 36 interconnecting the oxygen recess 32 with the ignition bore or orifice hole 34. The ignition bore or orifice hole 34 typically has a diameter of about 0.020 to about 0.030 inches, preferably about 0.027 inches, and an axial bore length of about 0.100 to about 0.150 inches. The second tapered or funnel shaped transition 36 generally tapers at an angle of about 45 to about 75 degrees, preferably 60 degrees, over an axial length of between about 0.02 and 0.13 inches.

The second tapered, funnel shaped transition 36 facilitates directing all of the flame generated during discharge of the primer 38 within the oxygen recess 32 straight into and through the ignition bore or orifice hole 34 and deep into the supply of gun powder 40, contained within the gun barrel 6, to facilitate rapid and a substantially complete burning of the gun powder 40 contained therein and a further detailed description concerning the importance of the same will follow.

The primer cavity 30, according to the present invention, is sized to have an interference fit with a specifically designed primer 38, e.g. an interference fit of between about 0.000 and 0.002 inches or so. The interference fit between the primer 38 and the primer cavity 30 facilitates a suitable seal between an exterior surface 42 of the primer 38 and an inwardly facing surface 44 of the primer cavity 30, upon discharge of the primer 38. This seal helps to contain substantially all the flame, gases and pressure produced upon discharge and burning of the propellant. By containing said gases generated by ignition of the gun powder 40, such gases are channeled or directed out of the muzzle end of the gun barrel 6 instead of being permitted to flow or blow back toward the firing assembly 10, via the ignition bore or orifice hole 34, the oxygen recess 32 and the primer cavity 30.

It is to be appreciated that the interference fit between the exterior surface of the casing of the primer and the inwardly facing surface of the primer cavity must be such that, upon detonation of the primer, the detonation sufficiently warms the casing of the primer to allow it to expand somewhat radially outwardly against the inwardly facing surface of the primer cavity to produce a substantially gas-tight seal between those two surfaces. In addition, the axial length of the primer as well as the axial length of the prime cavity must be sufficient to allow some rearward movement of the primer relative to the primer cavity, e.g. one to thirteen thousandths of an inch and more preferably about five or six thousandths of an inch while still maintaining a sufficiently gas-tight seal between those two surfaces.

In order to prevent the primer 38 from being dislodged from the primer cavity 30, upon the primer being discharged, a clearance or head space 48 is provided between the rearward facing striking surface of the primer 38 and the adjacent forward facing surface of the lock up system, e.g. in this embodiment 30 the adjacent forward facing solid surface 46 of the firing assembly 10. A head space 48 of approximately 0.000 inches to 0.007 inches, and more preferably a head space of about 0.002 inches to about 0.004 inches or so is provided. This head space 48 allows minor rearward movement of the primer 38, upon the primer 38 being discharged within the primer cavity 30, but prevents the primer 38 from being forced rearward a sufficient distance toward the firing assembly 10 such that the formed seal between the exterior surface 42 of the primer 38 and the inwardly facing surface 44 of the primer cavity 30 is broken or significantly compromised.

Now that the basic components of the present invention have been described, a further description concerning the proper discharge of the improved muzzle loader firearm 2, according to the present invention, will now be provided. The precise sequence of events remains somewhat unresolved, however the inventor believes that the improved breech plug/primer arrangement, according to the present invention, behaves in the following manner.

Once the muzzle loader firearm 2 is loaded in a typical manner and a primer 38 is suitably positioned in the primer cavity 30, the firearm is ready to be discharged at a desired target. Upon activating the firing assembly 10, by an operator of the firearm 2 squeezing or pulling the trigger 8, the spring loaded centrally located firing pin 11 moves quickly forward and strikes a central rear surface 56 of the primer 38 located in the primer cavity 30. The force of the central firing pin strikes against the rear surface 56 of the primer 38 and thereby detonates, discharges and/or ignites the charge contained within the primer in a conventional fashion. Such detonation, discharge and/or ignition causes the charge 58 of the primer 38 to explode. This explosion sufficiently heats the exterior casing 43 of the primer 38, which is typically manufactured from either plastic, copper or brass for example, and such explosion and heating induces the primer casing 43 to at least partially expand, e.g. about 0.001 to about 0.003 inches or so. The expansion of the primer casing 43 thereby partially forms a fluid tight seal between the outwardly facing surface 42 of the exterior casing 43 and the inwardly facing surface 44 of the primer cavity 30. This fluid tight seal helps facilitates a proper seal and prevents the escape of any significant gases past the primer and primer cavity interface.

As the charge 58 in the primer 38 explodes, ignites, and/or detonates, the created blast or heat is conveyed through the oxygen recess 32, where a supply of oxygen is previously trapped therein upon loading a primer 38 within the primer cavity 30. This trapper oxygen supply helps fuel the detonation, discharge and/or ignition of the primer charge 58 so that the detonated, discharged and/or ignited primer charge 58 bums at a hotter temperature. The blast or heat from the detonated, discharged and/or ignited primer charge 58 is funneled, by the second tapered or funnel shaped transition 36, through the ignition bore or orifice hole 34 and deep into the gun powder charge loaded in the breech end 12 of the gun barrel 6. The constriction created by at least the second tapered and funnel shaped transition 36 and the substantially smaller ignition bore or orifice hole 34 accelerates the flow of the generated flame produced in the oxygen recess as they are forced through the ignition bore or orifice hole 34 and into the breech end 18 of the barrel 6 igniting the powder 40 contained therein.

Upon the substantially complete burning of the gun powder 40 contained within the barrel 6, some of the created pressure flows back through the ignition bore or orifice hole 34 and causes some rearward movement of the primer 38 against the solid surface or head wall 46. This additional pressure is believed to further expand the primer casing 43 against the inwardly facing surface 44 of the primer cavity 30 to improve the fluid tight seal achieved between those components.

It is to be appreciated that the diameter and the length of both of the oxygen bore 32 and the ignition bore or orifice hole 34 can vary, from application to application, depending upon the type of gun powder employed, the burn rate of the gun powder and the C.U.P. pressure. In addition, the shape, size and/or overall dimensions of the primer cavity 30 can vary from application to application but the primer cavity 30 must be sized to accommodate closely a desired primer and achieve an interference fit therewith of between 0.000 and 0.002 inches.

The containment of the gases by the formed seal in combination with the unique arrangement of the breech plug 22 and its associated elements cause a desired and specifically defined and directed blast from the detonated, discharged and/or ignited primer charge 58 which, in turn, rapid ignites and/or explodes the gun powder 40 loaded in the gun barrel 6 adjacent to the end wall of the breech plug 22. The deep penetration of the flame and gases produced by the primer charge 58 into the gun powder 40 is an important element which, in combination with the rapid burning of the gun powder to create expansion gases, cause the loaded projectile to be swiftly accelerated and discharged from the muzzle end of the gun barrel 6.

Due to the disclosed arrangement, according to the present invention, the blast from the primer charge 58 is sufficiently hot enough to ignite conventional black powder and Pyrodex® gun powder as well as smokeless gun powder. Moreover, this generated heat from the blast from the primer charge 58 facilitates a proper and substantially complete discharge of substantially all of the loaded gun powder in the firearm 2 which propels the projectile, contained within the breech end 18 of the gun barrel 6, along the entire length of the gun barrel 6 and discharges the projectile out the muzzle end 19. The disclosed arrangement also minimizes the risk of the firearm 2 not being properly discharged, e.g. malfunctioning for one reason or another, upon the discharge of the primer 38.

The present invention also ensures a substantially complete discharge of black powder, Pyrodex®, and smokeless gun powder in a safe manner. In fact, on test firings of a firearm 2 according to the present invention, the inventor has been able to discharge a 270 grain projectile with a 115 grain charge of smokeless gun powder (e.g. Hodgdon Varget®) and achieve a projectile velocity of approximately 2800 feet per second out the muzzle end 19 of the gun barrel 6.

The head space, as seen in this FIG. 2, provides sufficient clearance for the muzzle loader firearm to be "opened", in a conventional manner, to allow access to and replacement of the primer once the firearm is discharged. The firing mechanism 10, according to one embodiment, is fastened to the stock portion of the barrel while the gun barrel, including the breach plug, are movable, e.g. pivotable, relative to the stock 10 to facilitate removal and replacement of the discharged. According to another embodiment, the gun barrel, including the breach plug, are fastened to the stock 10 while the firing mechanism 10 is movable, e.g. slidable, relative to the gun barrel to facilitate removal and replacement of the discharged.

It is to be appreciated that there are three important criteria which must be maintained to ensure a safe discharge of smokeless gun powder. The first is have a sufficiently tight fit, e.g. an interference fit of between about 0.000 and 0.002 inches or so, between the exterior casing 43 of the primer 38 and the inwardly facing surface 44 of the primer cavity 30 so that, upon discharging the primer 38, the primer exterior casing 43 expands slightly to provide a fluid tight seal with the inwardly facing surface 44 of the primer cavity 30 to essentially eliminate the possibility of any significant gases escaping therebetween. Secondly, there must be a sufficiently small head space 48 between a striking end face of the primer 38 and a solid surface or wall 46 of the firearm 2 to prevent excessive rearward movement of the primer 38, upon being discharged, so that the sufficiently tight seal, formed between the exterior casing 43 of the primer 38 and the inwardly facing surface 44 of the primer cavity 30, is not compromised. Thirdly, the size of the ignition bore or orifice hole 34 must be sufficiently large to facilitate thrusting the generated blast from the primer deep into the gun powder charge loaded in the breech end 18 of the gun barrel 6 while, at the same time, be sufficiently small enough to prevent excessive back pressure from flowing back thorough the ignition bore or orifice hole 34 to compromise the formed fluid tight seal between the exterior casing 43 and the inwardly facing surface 44 of the primer cavity 30, i.e. the ignition bore or orifice hole 34 typically has a diameter of about 0.020 to about 0.030 inches, preferably about 0.027 inches.

Figure 4:
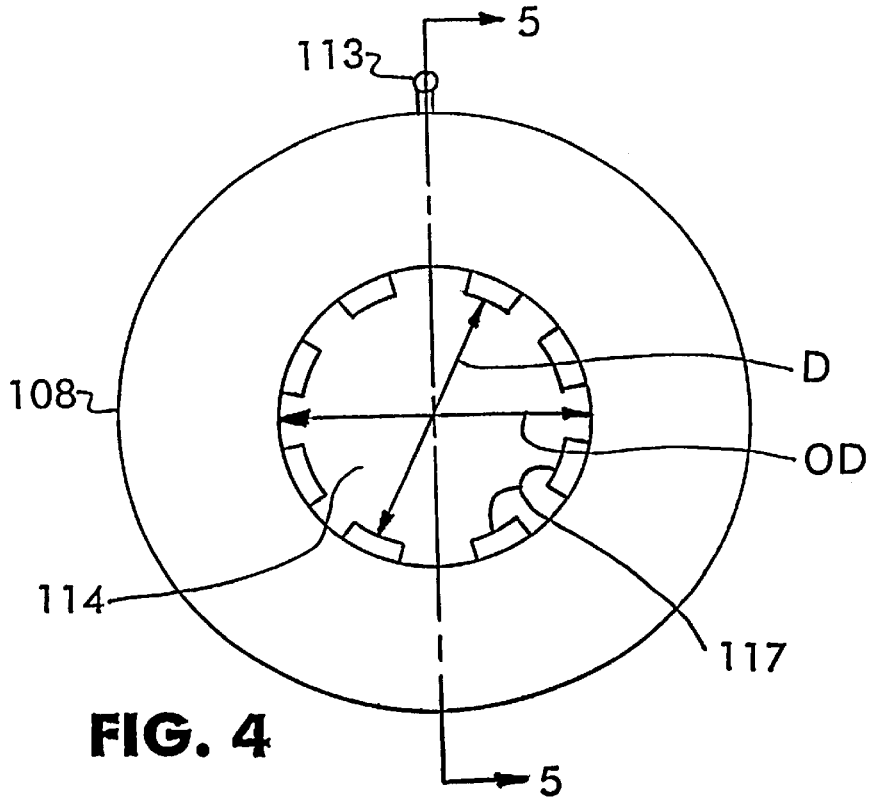
FIG. 4 is a diagrammatic end view of the muzzle of a first embodiment of a firearm according to the invention looking down into the barrel.
Figure 5:
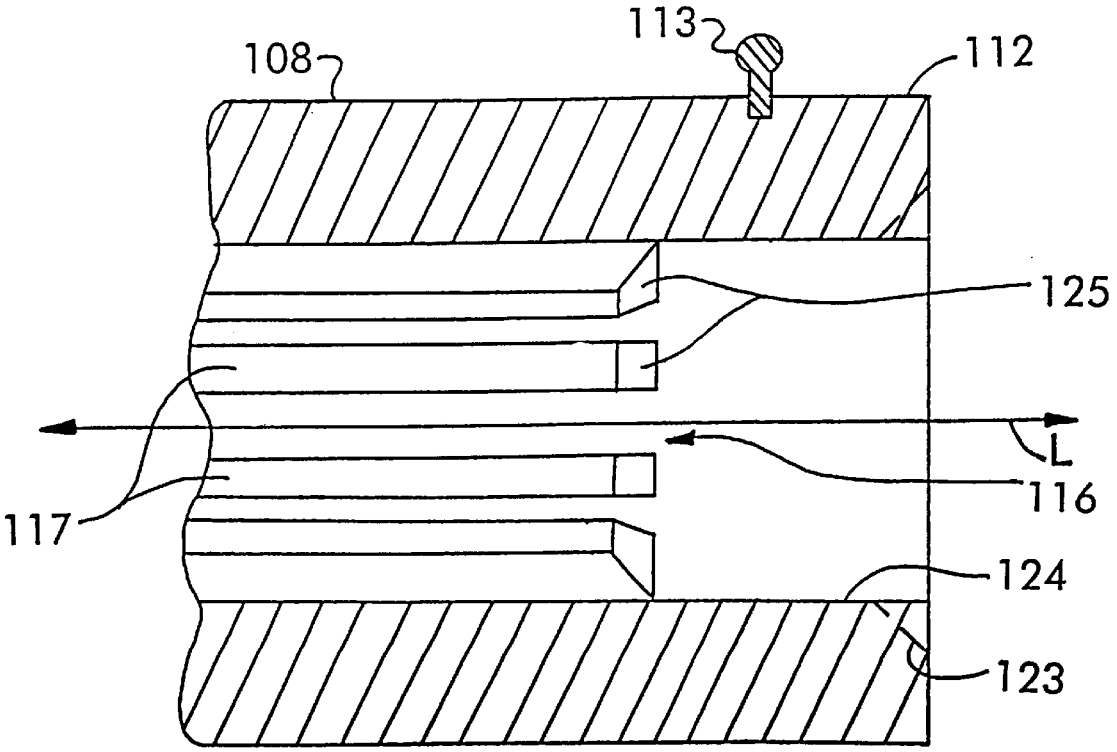
FIG. 5 is a fragmentary cross-sectional elevation of the muzzle end of the gun barrel along section line 5—5 of FIG. 4.

Turning now to FIGS. 4 and 5 a preferred embodiment of the gun barrel 108 will now be described in detail. The gun barrel 108 is provided with gun sight 113 and a central bore 114 which extends substantially along the entire length of the gun barrel 108 from adjacent the breech end to the muzzle end 112. A conventional helical rifling 116 of a desired pitch, depth, etc. and is formed on the inner surface of the central bore 114 to impart a desired spin to the projectile 118 (FIG. 6) as it is discharged from the gun barrel 108. The rifling 116 can be formed by swaging or any other well known suitable processes. The diameter D of the central bore 114 is typically 0.010's of an inch less than an outer diameter OD defined by the rifling, e.g. each rib of 117 of the rifling 116 is typically approximately 0.005's of an inch high. In a 50 caliber firearm, for example, the central bore would typically have a diameter D of 0.490's of an inch and the outer diameter OD defined by the rifling 116 would typically have a diameter of 0.500's of an inch, that is, the same diameter as the projectile to be fired by that caliber firearm. A chamfer 123, shown in ghost, may be formed at the entrance of the central bore to facilitate insertion of a projectile or a loading tool in the muzzle end of the gun barrel.

Figure 6:
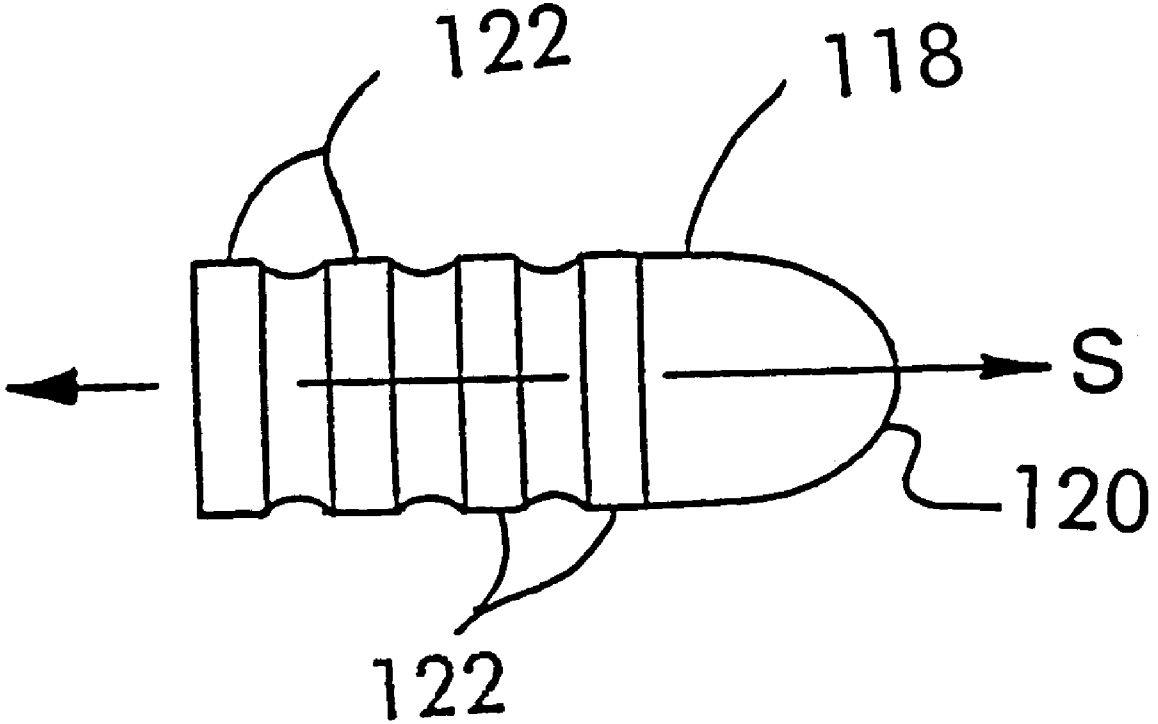
FIG. 6 is a side elevation of a conventional projectile suitable for being loaded and discharged out of the gun barrel according to the present invention.

As can be seen in FIG. 6, a typical projectile 118 comprises a forward impact point 120 and a cylindrical surface 122. It is to be appreciated that the cylindrical surface 122 can be one continuous surface or may comprise a plurality of sequentially arranged, spaced circumferential bands (four being shown in FIG. 6). The purpose of the cylindrical surface or surfaces 122 is to each engage the rifling 116 contained within the gun barrel and form a tight seal therewith and thereafter provide the projectile 118 with a desired rotational spin as it is discharged out the muzzle end of the gun barrel. The rate of spin of the projectile 118, upon being discharged, will depend upon the pitch of the rifling and the discharge velocity of the projectile as is well known in the art and thus the same is not discussed in any further detail.

A first cylindrical counterbore 124 is provided which extends inwardly from the muzzle end of the gun barrel 108. The counterbore 124 has a diameter which is substantially equal to the diameter of the projectile (caliber) to be discharged and is thus also substantially equal to the outer diameter OD defined by the rifling 116 of the gun barrel. The length of the counterbore 124 is substantially equal to the overall length of the cylindrical surface 122 of a projectile 118 of that caliber and typically will have a length from about 0.25 inches to about 1.75 inches for a 0.50 caliber projectile. As the first counterbore 124 has a diameter substantially equal to the diameter of the projectile and bore length substantially equal to the length of the cylindrical surface(s) 122 of the projectile 118, the first counterbore 124 substantially aligns the central longitudinal axis S of the projectile 118 with the central longitudinal axis L of the gun barrel and facilitates a complete, substantially uniform tight peripheral seal between the projectile 118 and the rifling 116 of the gun barrel thereby preventing gases, generated by the burning of the gun powder, upon the firing the firearm, from leaking between the projectile 118 and the inwardly facing surface of the gun barrel.

Since the projectile is typically manufactured of lead, it is easily deformable upon being forced into the rifling of the gun barrel. As the operator pushes the projectile towards the breech end of the barrel generally by use of the ramrod 12, the projectile will be rotated, by the rifling 116, as the projectile 118 is moved from the muzzle end 112 to the breech end of the gun barrel 108. To assist with insertion of the slug 118 into the rifling portion of the gun barrel, the rifling immediately adjacent and abutting the first counterbore 124 has a chamfer 125 or is provided with some other gradual transition therebetween. The deformation of the projectile 118 is such that the projectile entirely fills the bore 114 and the associated rifling grooves to provide a complete seal therewith.

Figure 7:
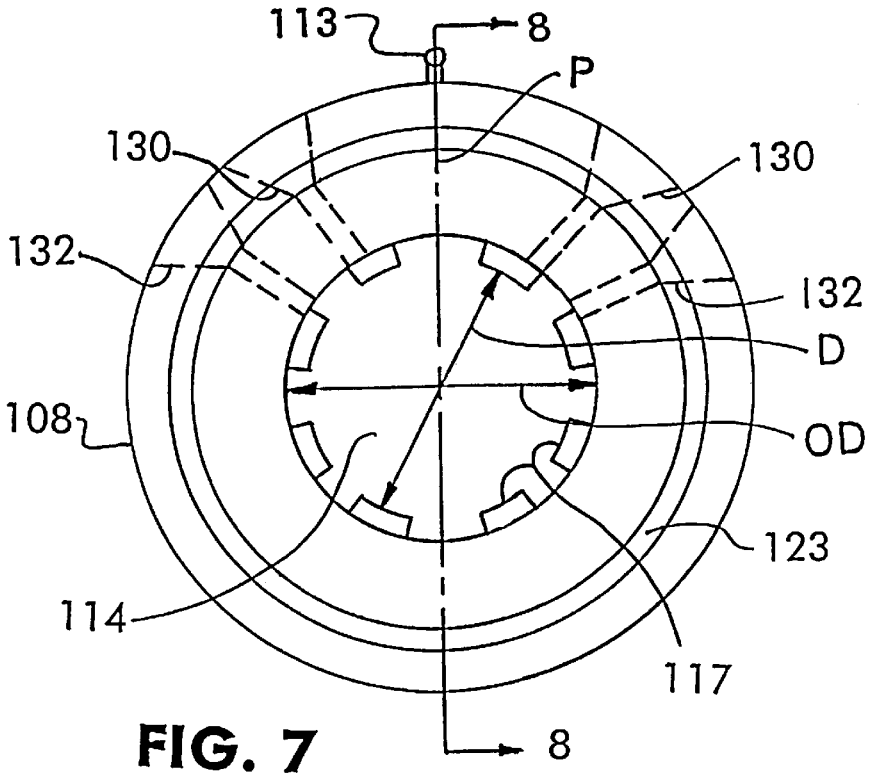
FIG. 7 is a diagrammatic end view of a second embodiment of a firearm according to the invention looking down into the barrel.
Figure 8:
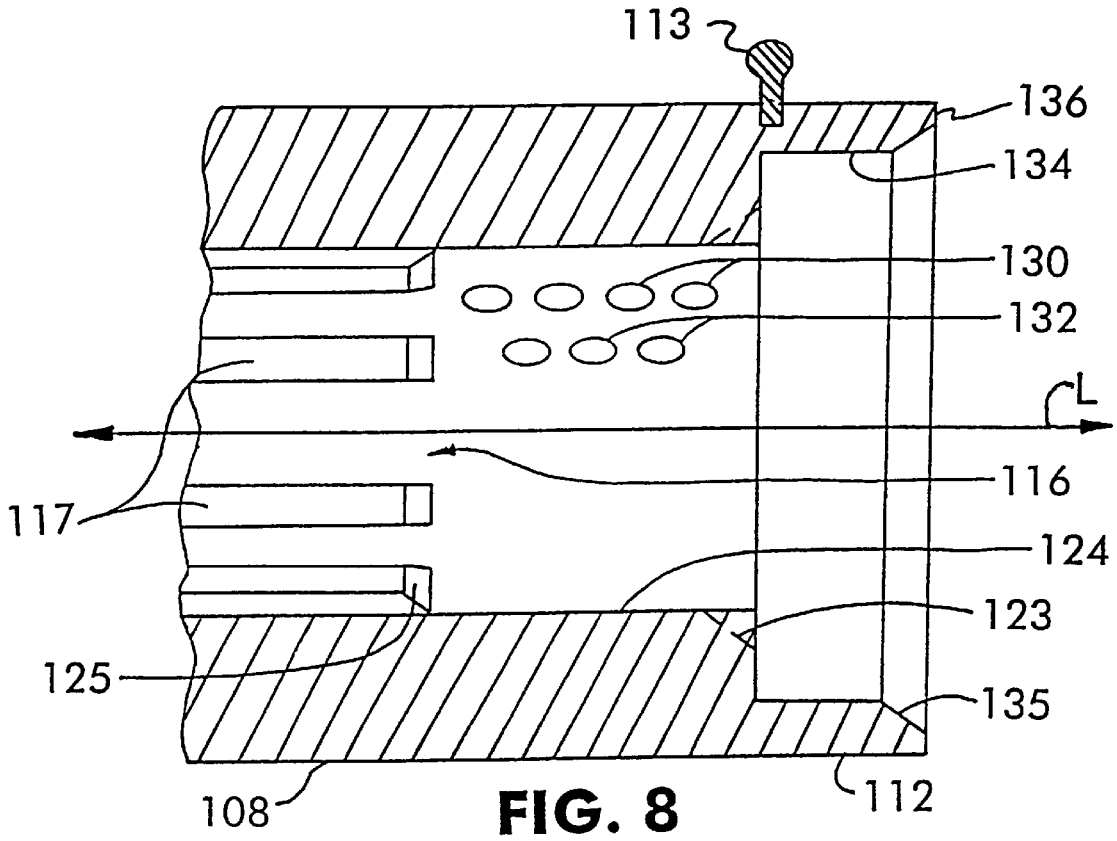
FIG. 8 is a partial cross-sectional view of the muzzle end of the gun barrel along section line 8—8 of FIG. 7.

Turning now to FIGS. 7 and 8, a second embodiment of the gun barrel can be seen and will be discussed in detail. This embodiment is substantially similar to the first embodiment of the gun barrel except that the length of the counterbore 124 has been increased in the muzzle end 112 of the gun barrel 108 in order to accommodate a plurality of openings (e.g. fourteen openings) 130, 132 extending completely through the wall of the gun barrel 108 with the axis of each hole being substantially perpendicular to the longitudinal axis L of the gun barrel 108. Four equally spaced sequentially arranged holes 130, each having a diameter of approximately 0.0625 to 0.250 inches, are provided at 30° on either sides of a central plane P defined by the longitudinal axis L of the gun barrel and three equally spaced sequentially arranged holes 132, each having a diameter of approximately 0.0625 to 0.250 inches, are provided at 60° on either sides of the central plane P defined by the longitudinal axis L of the gun barrel. The three holes 132 are located intermediate the four holes 130 axially of the longitudinal axis L. The purpose of the holes 130, 132 is to allow at least a portion of the gases, produced during discharge of the firearm, to be exhausted from the gun barrel via these holes 130, 132 as the projectile 118 exits the gun barrel. The gases which exit through those holes 130, 132 force the muzzle end of the gun barrel downward, i.e. the exhausted gases create a force opposing a recoil force imposed on the gun barrel, and compensate the natural tendency of the gun barrel 108 to "kick" upwardly (recoil) as it is discharged. The gun barrel 108 is also provided with gun sight 113.

A second cylindrical counterbore 134 is provided in the muzzle end 112 between a muzzle end face 136 of the gun barrel and the first cylindrical counterbore 124. The second cylindrical counterbore 134 is dimensioned so as to receive snugly a projectile loading tool 140, which will be discussed further in detail hereinafter. A second chamfer 135 is provided between the end face 136 of the muzzle end and the second cylindrical counterbore 134 to facilitate insertion of the loading tool within the muzzle end 112 of the gun barrel.

Figures 9, 10, 11:
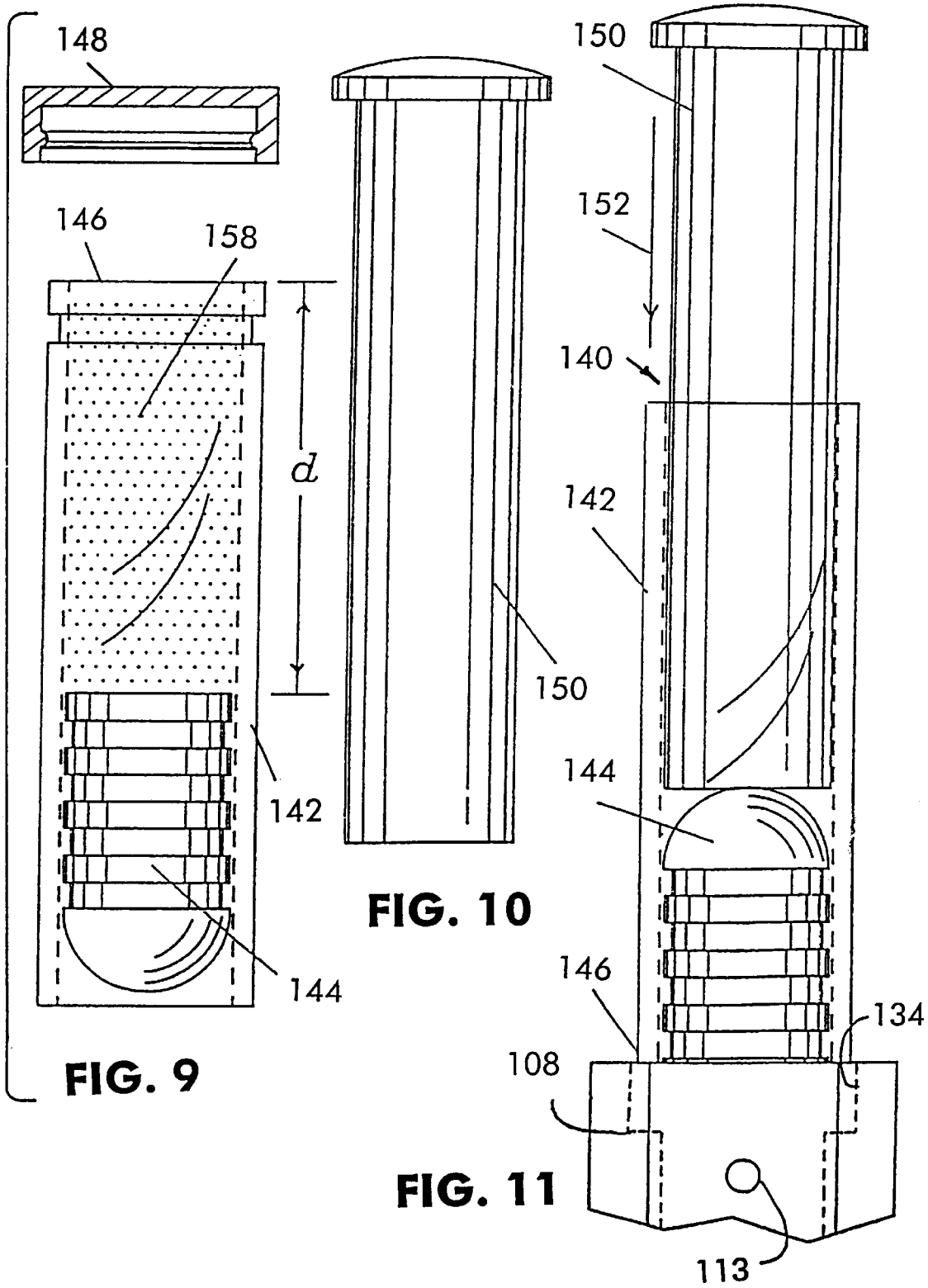
FIG. 9 is a diagrammatic side view of the body portion of the muzzle loader tool according to the present invention showing how a projectile and powder charge are stored therein.
FIG. 10 is a side elevational view of a plunger portion of the muzzle loader tool according to the present invention.
FIG. 11 is a diagrammatic side view of the assembled muzzle loader tool according to the present invention in the process of injecting its gun powder charge and projectile into the gun barrel of a muzzle loader.

Turning now to FIGS. 9 through 11, the muzzle loading tool 140 to be used in combination with the foregoing gun barrel to accomplish one of the stated objects of the present invention will now be described. The body portion 142 of the loading tool 140 is shown inverted in FIG. 9. That is, the bottom end is up as the Figure is viewed. Body portion 142 is cylindrical in shape and opened at both ends. It is made of a resiliently deformable plastic, such as polyethylene, and has an outside diameter sized to slide snugly into the second counterbore 134 of the gun barrel 108. The inside diameter of the loading tool 140 is sized to snugly accept a projectile or bullet 144 therein. The distance "d" between the bottom of a bullet 144 disposed therein and the bottom end 146 is selected so that a pre-established and desired measure or quantity of gun powder 158 will be contained therein. If desired, one or an opposed pair of snap-on plastic caps 148 can be provided therefor so that a number of preloaded charges can be conveniently assembled and carried by an operator.

To load the muzzle loader with the tool 140, one or both caps 148 are removed, if present, and the bottom end 146 is inserted into the second counterbore 134 of the gun barrel 108, as shown in FIG. 11, and the cylindrical plastic plunger member 150 of FIG. 10, having an outside diameter adapted to slide within the body portion 142, is used to push the projectile 144, e.g. the bullet, and the preloaded charge of gun powder 158 into the gun barrel 108 in the direction of arrow 152, following this the ramrod 12 is used, in a conventional manner, to ram the charge home.

Since certain changes may be made in the above described improved muzzle loader firearm, without departing from the spirit and scope of the invention herein involved, it is intended that all of the subject matter of the above description or shown in the accompanying drawings shall be interpreted merely as examples illustrating the inventive concept herein and shall not be construed as limiting the invention.

What is claimed is:

1. A muzzle loader firearm comprising:

a gun barrel having a breech end and a muzzle end, the breech end of the gun barrel supporting a removable breech plug having a primer cavity for supporting a desired primer for discharging the firearm, and the primer cavity communicating with an interior space of the breech end of the gun barrel via an ignition bore to facilitate discharge of the firearm when desired;

the primer having a sufficiently tight fit with the primer cavity so that upon detonation of the primer, an exterior casing of the primer expands to form a fluid tight seal with an inwardly facing surface of the primer cavity to minimize the passage of any gas therebetween, upon discharge of the firearm;

a firing pin assembly being provided for striking the primer, when desired, and discharging the firearm;

a trigger mechanism being coupled to the firing pin assembly to control actuation thereof;

a stock supporting at least the trigger mechanism, the firing pin assembly and the breech end of the gun barrel;

said firearm having a sufficiently small head space, being provided between a striking surface of the primer facing the firing pin assembly and an adjacent surface of the firing pin assembly, to prevent the primer from being forced sufficiently rearwardly, upon detonation of the primer, and compromising the fluid tight seal formed between the primer casing and the primer cavity;

the primer cavity communicates with the ignition bore via an oxygen recess which is sized to accommodate a sufficient quantity of oxygen to facilitate burning of a primer charge of the primer and facilitate substantially complete burning of gun powder loaded within the breach end of the barrel; and said ignition bore is substantially smaller than both said primer cavity and said oxygen recess, a tapered transition interconnects the oxygen recess with the ignition bore, and the tapered transition funnels the blast from the discharged primer through the ignition bore directly into gun powder supported by the breech end of the barrel to facilitate a complete and substantially instantaneous burning of the gun powder located therein.

2. The muzzle loader firearm according to claim 1, wherein an inner surface of said gun barrel is rifled to provide desired rotation to a projection discharged from the muzzle loader firearm.

3. The muzzle loader firearm according to claim 2, wherein said rifled gun barrel has a first counterbore therein spaced from a muzzle end face of said gun barrel, said first counterbore has a diameter substantially equal to a maximum diameter of the rifling of said gun barrel and said first counterbore has a length sufficient to facilitate desired alignment of a projectile, of a mating caliber for said rifled gun barrel, as a said projectile is being inserted into said muzzle end of said gun barrel.

4. The muzzle loader firearm according to claim 3, wherein said gun barrel has a second counterbore with a diameter that is larger than a diameter of said first counterbore, said second counterbore extends from said muzzle end face of said gun barrel to said first counterbore, and said second counterbore is dimensioned so as to allow a projectile loading tool to be inserted therein.

5. The muzzle loader firearm according to claim 3, wherein said rifling of said gun barrel is provided with a chamfer to facilitate insertion of a said projectile from said first counterbore into said rifling of said gun barrel.

6. The muzzle loader firearm according to claim 4, wherein a chamfer is provided between said end face of said muzzle end and said second counterbore to facilitate insertion of a said loading tool into said second counterbore.

7. The muzzle loader firearm according to claim 4, wherein a chamfer is provided between said first and second counterbores to facilitate insertion of a said projectile within said first counterbore.

8. The muzzle loader firearm according to claim 7, wherein openings are provided in said first counterbore of said gun barrel, said openings extending completely through a wall of said gun barrel along axes substantially perpendicular to the longitudinal axis of said gun barrel, said openings allowing gases, created upon discharge of a said projectile from said gun barrel, to exit through said openings and create a force opposing a recoil force of said gun barrel.

9. The muzzle loader firearm according to claim 5, wherein said first counterbore has a length of from about 0.25 to about 1.75 inches.

10. The muzzle loader firearm according to claim 4, in combination with a projectile loading tool for loading a muzzle loader barrel, wherein said projectile loading tool comprises an elongated hollow body portion that is opened at opposed first and second ends thereof and has an outer dimension sized to snugly slide into said second counterbore of said gun barrel, said body portion has an inside diameter sized to snugly accept a said projectile, of said mating caliber for said gun barrel, therein and has a length such that a distance between a bottom of a said mating caliber projectile, once said projectile is provided therein, and said second opened end of said body portion accommodates a desired measure of gun powder; and a plunger member has an outer dimension having a sliding fit with the inside diameter of said body portion whereby with said body portions loaded with a said mating caliber projectile and the desired measure of gun powder, and when said second open end of said body portion is inserted into said second counterbore of said gun barrel, said plunger member is inserted into said first opened end of said body portion, against said mating caliber projectile, for pushing said projectile and the desired measure of gun powder into said gun barrel, following which said mating caliber projectile is further insertable into said gun barrel by a ramrod.

11. The muzzle loader firearm as set forth in claim 1, wherein said head space has a width that less than a longitudinal length of said primer such that upon discharge of the firearm and the primer being forced rearward due to discharge of said firearm, the primer is prevented for being forced completely out from the primer cavity.

12. The muzzle loader firearm as set forth in claim 1 wherein said ignition bore is substantially smaller than said primer cavity thereby boring a constriction which causes an acceleration of the blast from the primer as the blast is conveyed through said breech plug toward the gun powder situated in the breech end of the barrel.

13. The muzzle loader firearm as set forth in claim 1, wherein said ignition bore has a diameter of between about 0.017 to about 0.040 inches.

14. The muzzle loader firearm as set forth in claim 1, wherein the exterior casing of the primer and the inwardly facing surface of the primer cavity have an interference fit of between about 0.000 and 0.006 inches so that, upon discharging the primer, the primer exterior casing expands slightly to provide a fluid tight seal between the inwardly facing surface of the primer cavity to minimize any gases escaping therebetween.

15. The muzzle loader firearm as set forth in claim 1, wherein the sufficiently small head space, formed between a striking end face of the primer and a solid wall of the firearm, prevents excessive rearward movement of the primer, upon being discharged, so that the sufficiently tight seal, formed between the exterior casing of the primer and the inwardly facing surface of the primer cavity is not compromised.

16. A muzzle loader firearm comprising:

a gun barrel having a breech end and a muzzle end, the breech end of the gun barrel supporting a breech plug having a primer cavity for supporting a desired primer for discharging the firearm, and the primer cavity communicating with an interior space of the breech end of the gun barrel, via an ignition bore, to facilitate discharge of the firearm;

the primer having a sufficiently tight fit with the primer cavity so that upon detonation of the primer, an exterior casing of the primer expands to form a fluid tight seal with an inwardly facing surface of the primer cavity to minimize the passage of any gas therebetween, upon discharge of the firearm;

a firing pin assembly being provided for striking the primer and discharging the firearm;

a trigger mechanism being coupled to the firing pin assembly to facilitate actuation thereof;

a stock supporting the trigger mechanism,.the firing pin assembly and at least the breech end of the gun barrel;

the primer cavity communicates with the ignition bore via an oxygen recess; and said ignition bore is substantially smaller than both said primer cavity and said oxygen recess, a tapered transition interconnects the oxygen recess with the ignition bore and the tapered transition funnels the blast from the discharged primer through the ignition bore directly into gun powder supported by the breech end of the barrel to facilitate a complete and substantially instantaneous burning of the gun powder located therein.

17. The muzzle loader firearm as set forth in claim 16, wherein the firearm has a sufficiently small head space, provided between a striking surface of the primer facing the firing pin assembly and an adjacent surface of the firing pin assembly, to prevent the primer from being forced sufficiently rearwardly, upon detonation of the primer, and compromising the fluid tight seal formed between the primer casing and the primer cavity.

18. The muzzle loader firearm as set forth in claim 17, wherein said head space has a width that less than a longitudinal length of said primer such that upon discharge of the firearm and the primer being forced rearward due to discharge of said firearm, the primer is prevented for being forced completely out from the primer cavity.

19. The muzzle loader firearm as set forth in claim 16, wherein the oxygen recess is sized to accommodate a sufficient quantity of oxygen to facilitate burning of a primer charge of the primer and facilitate substantially complete burning of gun powder loaded within the breach end of the barrel, upon discharge of the firearm.

20. A method of discharging a muzzle loader firearm containing smokeless gun powder, the method comprising the steps of:

providing a gun barrel with a breech end and a muzzle end, supporting a breech plug in the breech end of the gun barrel, the breech plug having a primer cavity for supporting a desired primer for discharging the firearm, and the primer cavity communicating with an interior space of the breech end of the gun barrel via an ignition bore to facilitate discharge of the firearm when desired;

placing the primer at least partially within the primer cavity with the primer having a sufficiently tight fit with the primer cavity so that upon detonation of the primer, an exterior casing of the primer expands to form a fluid tight seal with an inwardly facing surface of the primer cavity to minimize the passage of any gases therebetween upon discharge of the firearm;

providing a firing pin assembly for striking the primer, when desired, and discharging the firearm;

coupling a trigger mechanism to the firing pin assembly to control actuation thereof;

supporting at least the trigger mechanism, the firing pin assembly and the breech end of the gun barrel by a stock;

providing said firearm with a sufficiently small head space, between a striking surface of the primer facing the firing pin assembly, and an adjacent surface of the firing pin assembly, to prevent the primer from being forced sufficiently rearwardly, upon detonation of the primer, and compromising the fluid tight seal formed between the primer casing and the primer cavity;

connecting the primer cavity with the ignition bore via an oxygen recess, and sizing the oxygen recess to accommodate a sufficient quantity of oxygen to facilitate burning of a primer charge of the primer and facilitate substantially complete burning of gun powder loaded within the breach end of the barrel;

forming said ignition bore so as to be substantially smaller than both said primer cavity and said oxygen recess, interconnecting the oxygen recess with the ignition bore via a tapered transition, and the tapered transition funnels the blast from the discharged primer through the ignition bore directly into gun powder supported by the breech end of the barrel to facilitate a complete and substantially instantaneous burning of the gun powder located therein.

* * * * *